US008297558B2

(12) United States Patent
O'Dell et al.

(10) Patent No.: US 8,297,558 B2
(45) Date of Patent: Oct. 30, 2012

(54) CROSSING PREDICTOR WITH AUTHORIZED TRACK SPEED INPUT

(75) Inventors: Randy M. O'Dell, Blue Springs, MO (US); Patrick J. Venneman, Blue Springs, MO (US)

(73) Assignee: Safetran Systems Corporation, Louisville, KY (US)

( * ) Notice: Subject to any disclaimer, the term of this patent is extended or adjusted under 35 U.S.C. 154(b) by 22 days.

(21) Appl. No.: 12/725,661

(22) Filed: Mar. 17, 2010

(65) Prior Publication Data

US 2011/0226909 A1 Sep. 22, 2011

(51) Int. Cl.
*B61L 1/02* (2006.01)

(52) U.S. Cl. ..... 246/126; 246/293

(58) Field of Classification Search ..... 246/111, 246/113, 114 R, 117, 115, 122 R, 182 R, 246/125, 126, 128, 130, 292, 293, 473.1; 340/917, 933; 701/19, 20

See application file for complete search history.

(56) References Cited

U.S. PATENT DOCUMENTS

| | | | | |
|---|---|---|---|---|
| 2,106,682 | A | 1/1938 | Field et al. | |
| 2,719,218 | A | 9/1955 | Miller | |
| 3,268,723 | A | 8/1966 | Failor et al. | |
| 3,610,920 | A | 10/1971 | Frielinghaus | |
| 4,015,082 | A | 3/1977 | Matty et al. | |
| 4,065,081 | A | 12/1977 | Huffman et al. | |
| 4,172,576 | A | 10/1979 | Svet, Jr. et al. | |
| 4,324,376 | A * | 4/1982 | Kuhn | 246/125 |
| 4,498,650 | A | 2/1985 | Smith et al. | |
| 4,582,279 | A | 4/1986 | Pontier | |
| 4,737,968 | A | 4/1988 | Norton et al. | |
| 4,855,737 | A | 8/1989 | Poole | |
| 5,029,780 | A | 7/1991 | Peel | |
| 5,469,112 | A | 11/1995 | Lee | |
| 5,554,982 | A | 9/1996 | Shirkey et al. | |
| 5,590,855 | A | 1/1997 | Kato et al. | |
| 5,739,768 | A | 4/1998 | Lane et al. | |
| 5,864,304 | A * | 1/1999 | Gerszberg et al. | 340/903 |
| 5,890,682 | A * | 4/1999 | Welk | 246/125 |
| 5,954,299 | A * | 9/1999 | Pace | 246/293 |
| 6,011,508 | A | 1/2000 | Perreault et al. | |
| 6,025,789 | A | 2/2000 | Lane et al. | |
| 6,179,252 | B1 * | 1/2001 | Roop et al. | 246/293 |

(Continued)

FOREIGN PATENT DOCUMENTS

| | | |
|---|---|---|
| CA | 1149918 | 7/1983 |

(Continued)

OTHER PUBLICATIONS

English language abstract of TW 455553, published Sep. 21, 2001.

(Continued)

*Primary Examiner* — Jason C Smith
(74) *Attorney, Agent, or Firm* — DLA Piper LLP US

(57) ABSTRACT

A method and apparatus for controlling a grade crossing warning system employs a track occupancy circuit or other device to detect the presence of a train in the approach to a grade crossing and an indirect indication of a maximum authorized speed of the train in order to determine an amount of time to delay activation of the grade crossing warning system after the train has been detected. The indirect indication is preferably encoded onto a signal associated with the track occupancy circuit, preferably using a frequency shift technique. The indirect indication may be supplied by a wayside signal device.

18 Claims, 4 Drawing Sheets

U.S. PATENT DOCUMENTS

| | | | | |
|---|---|---|---|---|
| 6,218,961 | B1 * | 4/2001 | Gross et al. | 340/903 |
| 6,220,552 | B1 | 4/2001 | Ireland | |
| 6,572,056 | B2 * | 6/2003 | Berry et al. | 246/115 |
| 6,823,026 | B2 | 11/2004 | Mueller et al. | |
| 6,830,224 | B2 * | 12/2004 | Lewin et al. | 246/167 R |
| 7,098,774 | B2 | 8/2006 | Davenport et al. | |
| 7,254,467 | B2 * | 8/2007 | Fries et al. | 701/19 |
| 7,523,893 | B2 * | 4/2009 | Francis et al. | 246/34 A |
| 7,575,202 | B2 * | 8/2009 | Sharkey et al. | 246/293 |
| 7,618,010 | B2 * | 11/2009 | Fries | 246/122 R |
| 7,832,691 | B2 * | 11/2010 | Reibeling et al. | 246/125 |
| 2008/0101481 | A1 * | 5/2008 | Al-Eidan | 375/260 |

FOREIGN PATENT DOCUMENTS

| | | |
|---|---|---|
| CN | 1491846 | 4/2004 |
| EP | 0 165 048 | 12/1985 |
| EP | 0 878 373 | 11/1998 |
| EP | 1338492 | 8/2003 |
| GB | 1546942 | 5/1979 |
| JP | 11020702 | 1/1999 |
| JP | 2006168382 | 6/2006 |
| JP | 2006327290 | 12/2006 |
| JP | 2008-137400 | 6/2008 |
| KR | 10-2003-0011127 | 2/2003 |
| KR | 10-2004-0060261 | 7/2004 |
| KR | 10-2004-0106864 | 12/2004 |
| KR | 10-2009-0104379 | 10/2009 |
| TW | 455553 | 9/2001 |
| WO | WO 91/11356 | 8/1991 |

OTHER PUBLICATIONS

English language abstract of CN 1491846, published Apr. 28, 2004.
English language abstract of JP 11-020702, published Jan. 26, 1999.
English language abstract of JP 2006-327290, published Dec. 7, 2006.
Machine English language translation of JP 2006-327290, published Dec. 7, 2006.
English language abstract of JP 2006-168382, published Jun. 29, 2006.
Machine English language translation of JP 2006-168382, published Jun. 29, 2006.
English language abstract of SU 1592204, published Sep. 15, 1990.
"How Railroad Crossing Signals Work",http://matt.zont.org/signals/crossing/xngworks/xngworks/html, last revised Jan. 10, 2007, 28 pages.
English language abstract of JP 2008-137400, published Jun. 19, 2008.
Machine English language translation of JP 2008-137400, published Jun. 19, 2008.
GE Transportation ElectroLogIXS XP4: For Crossing Prediction, 2 pgs, believed to be published before Mar. 2, 2010.
Engelbrecht, Roelof J., "The Effect of Variation in Railroad Warning Time on Traffic Signal Preemption," Texas Transportation Institute, pp. 1-19, believed to be published before Mar. 2, 2010.
Victrack Access, "Low Cost Level Cross Warning Device," pp. 1-14, First Release, Jun. 6, 2008.
C3 Trans Systems LLC, "New Crossing Technology, Model HRI 2000: Improved Grade Crossing Warning System," 2 pages, 2004.
Russel, Michael, "High-Speed Rail Program: Integrated Quad Gate Crossing Control System," IDEA, Transportation Research Board, National Research Council, pp. 1-28, Dec. 2001.
Li, Meng et al., "Analysis Toward Mitigation of Congestion and Conflicts at Light Rail Grade Crossings and Intersections," California PATH Research Report, UCB-ITS-PRR-2009-9, Final Report for Task Order 5407, pp. 1-55, Jan. 2009.
http://www.southbaysignal.com/crossing.htm, South Bay Signal LLC, Grade Crossing Warning Systems, printed Apr. 20, 2010.
English language abstract of KR 10-2009-0104379, published Oct. 6, 2009.
English language abstract of KR 10-2004-0106864, published Dec. 18, 2004.
English language abstract of KR 10-2003-0011127, published Feb. 6, 2003.
English language abstract of KR 10-2004-0060261, published Jul. 6, 2004.

* cited by examiner

CROSSING PREDICTOR WITH AUTHORIZED TRACK SPEED INPUT

BACKGROUND

This invention relates to warning systems for what are known in the U.S. as railroad grade crossings (sometimes referred to in the U.K. as level crossings), which are locations at which railroad tracks intersect roads. The warning systems typically include lights, bells and a gate arm that blocks the road when a train is approaching the crossing.

The lights, bells and gate arms of the warning system are typically controlled by a controller that includes an input from a grade crossing predictor circuit. Grade crossing predictor circuits are able to determine a distance from the train to the crossing and can determine whether the train is approaching the crossing or moving away from the crossing. This ability allows the controller to activate the warning system with a constant warning time prior to the train reaching the crossing. These circuits typically employ tuned shunts at either end of an approach area to a crossing and work by transmitting a signal (typically a low frequency signal in the audio range) through the rails and shunts and sensing an inductance (or impedance) of the circuit formed by the track rails and shunts. When a train approaches a crossing, the train's axles and wheels create a short circuit between the rails, which lowers the total apparent inductance. By monitoring the inductance or impedance changes, the distance and speed of the train can be determined so that the warning system can be activated with a constant warning time.

Unfortunately, grade crossing predictor circuits do not work in all circumstances. For example, grade crossing predictor circuits may not work, or may not work reliably, in electrified territory (i.e., territory in which propulsion current is supplied through a third rail or a catenary wire system) and other areas with significant electromagnetic interference. In such circumstances, it is necessary to provide an alternative technique for controlling a warning system for a grade crossing.

One possible alternative technique is to control the grade crossing using a signal from a track occupancy circuit. A track occupancy circuit is a type of circuit that detects the presence or absence of a train in a section of track. A grade warning system controller can be configured such that the warning system activates when the track occupancy circuit indicates that a train is present in a section of track prior (with respect to a direction in which the train in traveling) to the grade crossing. In systems such as these, the length of the section of track monitored by the track occupancy circuit is chosen such that detection of a train traveling at the fastest authorized train speed in the block of track monitored by the track circuit will result in activation of the warning system at a desired amount of time prior to arrival of the train at the crossing.

Systems such as these suffer from a significant drawback: since the warning system activates as soon as a train is detected in the section of track monitored by the block occupancy circuit, a train traveling at a speed significantly lower than a maximum authorized speed will result in activation of the warning system a significantly longer period of time prior to arrival of the train at the crossing than is necessary or desired.

DETAILED DESCRIPTION

In the following detailed description, a plurality of specific details, such as types of encoding schemes and types of track occupancy circuits, are set forth in order to provide a thorough understanding of the preferred embodiments discussed below. The details discussed in connection with the preferred embodiments should not be understood to limit the present inventions. Furthermore, for ease of understanding, certain method steps are delineated as separate steps; however, these steps should not be construed as necessarily distinct nor order dependent in their performance.

One way in which the problem discussed above may be solved is to utilize an indication of the presence of a train from a track occupancy circuit together with an indication of the speed of the train to control a grade crossing warning system. The speed and presence of the train may be determined using a sensor that directly detects the train and measures the speed of the train, such as a radar or laser system similar to those used by police departments. The speed of the train may be used to select or calculate a desired delay, after which a grade crossing warning system will be activated. The use of such sensor devices has some drawbacks, not the least of which is the necessity of installing and maintaining additional equipment.

Another solution discussed in detail herein is to use another signal that indirectly indicates a speed of the train together with the indication of train presence from the track occupancy circuit in order to control the grade crossing warning system. An example of a signal that indirectly indicates a speed of the train is a signal aspect associated with the block of track. The signal aspect indicates the maximum allowable speed of the train. By assuming the train is traveling at the maximum allowable speed indicated by the signal aspect (which can change frequently over time), rather than the maximum allowable speed for the section of track (which is typically permanent, although sometimes changes temporarily), the amount of time wasted by a premature triggering of the grade crossing warning system can be significantly reduced or even eliminated.

Figure 1:
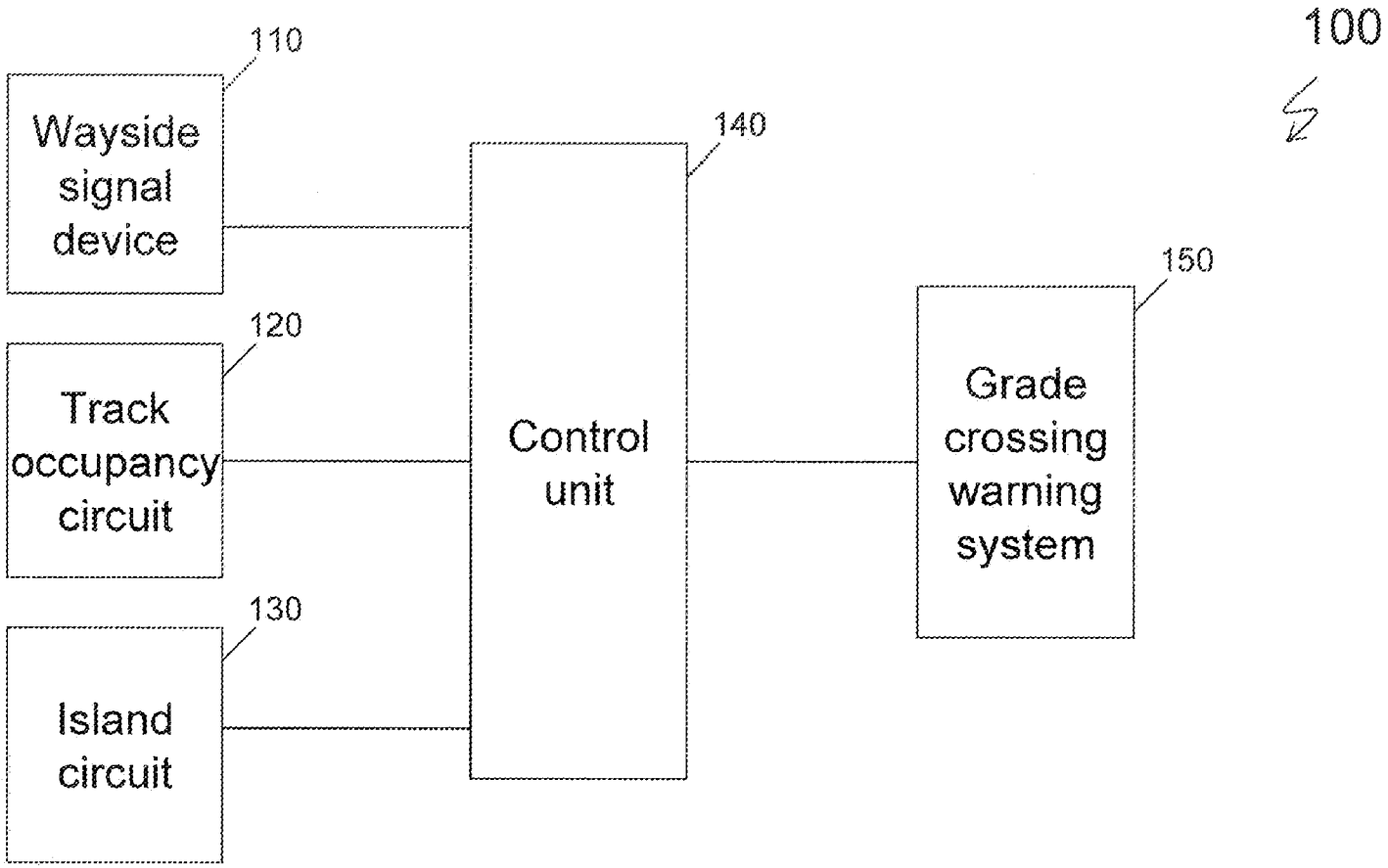
FIG. 1 is a block diagram of an embodiment of grade crossing control system.

An embodiment of such a system 100 is illustrated in FIG. 1. The system 100 includes a wayside signaling device 110. Wayside signaling device 110 can be any type of wayside signaling device known in the art. Such wayside signaling devices often include colored lamps to indicate to a train operator the maximum allowable speed. The number of lamps and allowable combinations vary widely. In one simple scheme, three signal lamps colored green, yellow and red are provided and one colored lamp is lit at any particular moment. In this system, green signifies clear and that a train is allowed to proceed at the maximum authorized speed for that track and train; yellow signifies caution and that a train may only move at a reduced speed relative to the maximum authorized speed; and red means that a train is not permitted to enter the block of track associated with the signal aspect. It should be noted herein that the block of track associated with the signal aspect may be the same or different from the block of track associated with the track occupancy circuits discussed herein that are used in the approaches to a grade crossing. Other signaling systems include more than three colored lamps and allow more than one lamp to be lit at any one time.

As is known in the art, the lamps may be controlled automatically by track occupancy circuits (e.g., an ABS, or automatic block signaling, system) which again may be the same or different from those track occupancy circuits used for control of the grade crossing warning system, by a central office (e.g., a centralized track control, or CTC, system), or by other means. In addition to lighted wayside signal devices, wayside signaling device 110 can also include devices and systems that provide signal aspect information to a train electronically/electrically such as by radio or through the rails (e.g., cab signal systems).

In addition to wayside signal device 110, the system 100 also includes a track occupancy circuit 120. The track occupancy circuit 120 may be any type of track occupancy circuit, and is preferably an AC track occupancy circuit. The track occupancy circuit 120 outputs a signal that indicates whether or not a train is present in a block of track associated with the track occupancy circuit. The system 100 also includes an island circuit 130, which is a track occupancy circuit that detects the presence of a train in the area of track that intersects the road (referred to in the art as the "island"). A signal aspect from the wayside signal device 110, a signal indicative of the presence of a train in the track block from the track occupancy circuit 120, and a signal from the island circuit 130 are fed to a control unit 140. The wayside signal device 110, the track occupancy circuit 120 and the island circuit 130 may be connected to the control unit 140 by line wire, by buried cable, by a radio link, or by any other suitable means. The control unit 140 may be realized using a microprocessor, a digital signal processor, a microcontroller, discrete logic, a combination thereof, or any other suitable technology. The control unit 140 uses the inputs from the wayside signaling device 110, the track occupancy circuit 120 and the island circuit 130 to control a grade crossing warning system 150. As discussed above, the grade crossing warning system 150 can include lights, bells, and/or a crossing gate (not shown in FIG. 1).

Operation of the control unit 140 will be discussed with reference to the flowchart 200 of FIG. 2. The control unit 140 inputs a signal aspect from the wayside signal device 110 at step 202 and determines the maximum speed associated with that signal aspect at step 204. The maximum speeds associated with each possible signal aspect may be stored in a database associated with the control unit 140, in which case step 204 may be performed by a simple table lookup. Those of skill in the art will recognize that other techniques are also possible. Next, the control unit 140 determines based on the signal input from the track occupancy circuit 120 whether a train has been detected at step 206. If no train has been detected, steps 202 and 204 are repeated.

If a train is detected at step 206, the delay period is determined at step 208 based on the maximum allowable speed determined at step 204. The delay period is the amount of time after the detection of a train that the control unit will wait before activating the grade crossing warning system 150. The delay period will depend upon the maximum allowable speed of the train and the distance from the start of the block of track monitored by the track occupancy circuit 120 to the road (this distance is sometimes referred to as the approach length). The approach length is typically chosen such that no delay is necessary for a train traveling at the maximum authorized speed, so that the grade crossing warning system 150 is activated immediately upon detection of a train by the track occupancy circuit 120 when the signal aspect is at its most permissive. For slower traveling trains (as indicated by signal aspect), a delay between the detection of the train by the track occupancy circuit and the activation of the warning system 150 is needed to avoid having the warning system 150 activated (and the road blocked) for longer than necessary. Those of skill in the art will recognize that this step 208 may also be performed by a table lookup using the maximum speed as an index. Those of skill in the art will further recognize that step 208 may be combined with step 204 in some embodiments by using the signal aspect as an index into a table of delay periods, which can be calculated in advance because the approach length and the maximum speeds associated with each signal aspect are predetermined.

After the delay has been determined at step 208, the control unit 140 starts an internal delay timer and determines when the delay timer times out at step 210. If the delay timer times out at step 210, the control unit 140 activates the warning system 150 at step 212. The control unit 140 then waits until the train is detected by the island circuit 130 at step 214, which signifies that the train has reached the road. Next, the control unit 140 waits until the island circuit indicates that the train is no longer detected by the island circuit 130 at step 216, which indicates that the train has moved past the road. The control unit 140 then deactivates the warning system 150 and the process is repeated.

Figure 2:
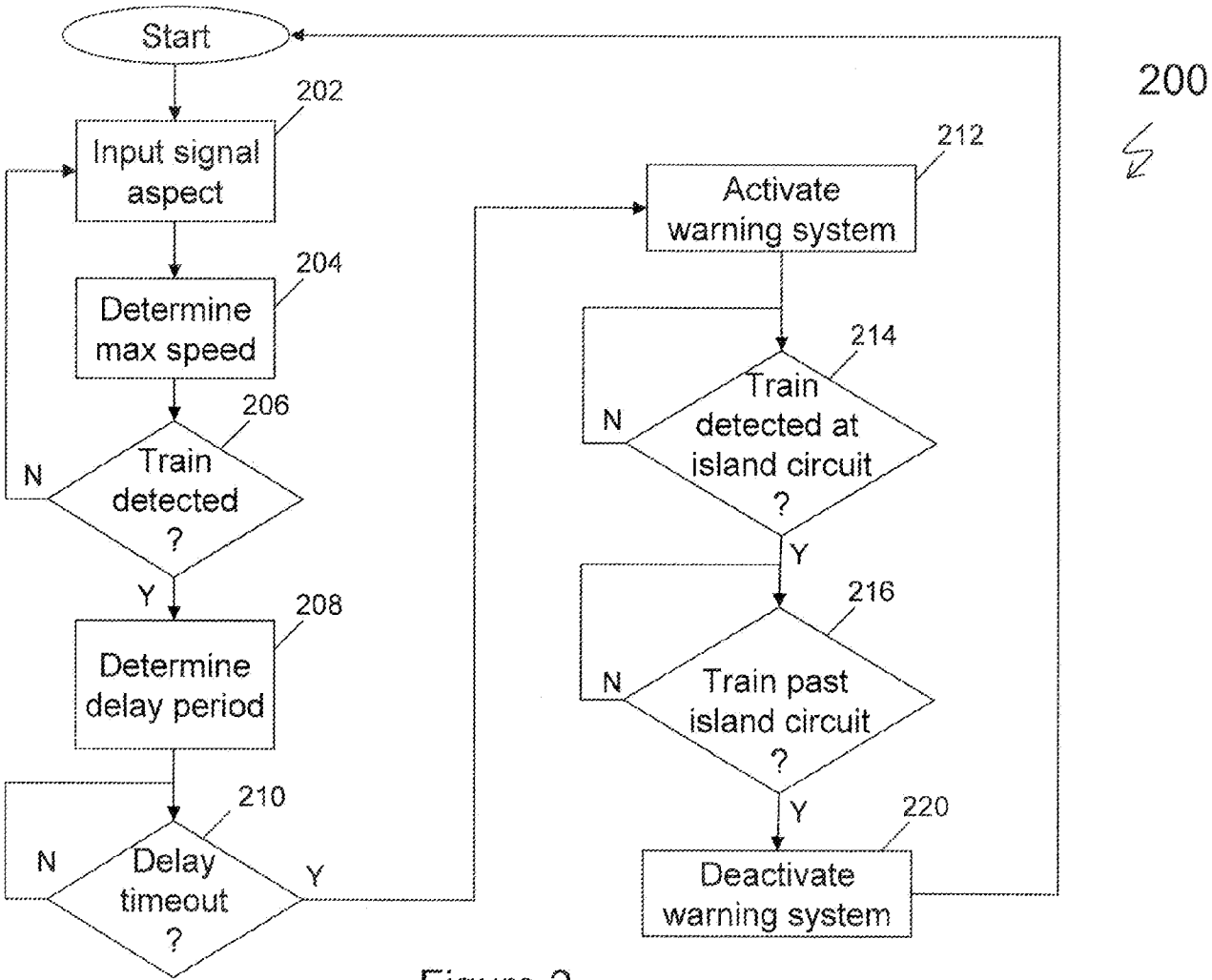
FIG. 2 is flowchart of processing performed by a control unit of the system of FIG. 1.

In the embodiment of FIGS. 1 and 2 discussed above, no provision is made for the possibility that the signal aspect would change to a less restrictive value (e.g., from yellow to green), and the train would accelerate in response to the less restrictive signal aspect, after the delay was determined. In order to accommodate such a situation, the control unit 140 periodically checks the wayside signal device 110 during the delay period and, if a change to a less restrictive signal is detected, either the delay period is adjusted accordingly or warning system 150 is activated immediately. In yet other embodiments, the control unit 140 notifies the wayside signal device 110 when a train is detected by the track occupancy circuit 120, and the wayside signal device 110 is configured to notify the control unit 140 of a change to a less restrictive signal aspect during a time when the train is detected by the track occupancy circuit 120.

Figure 3:
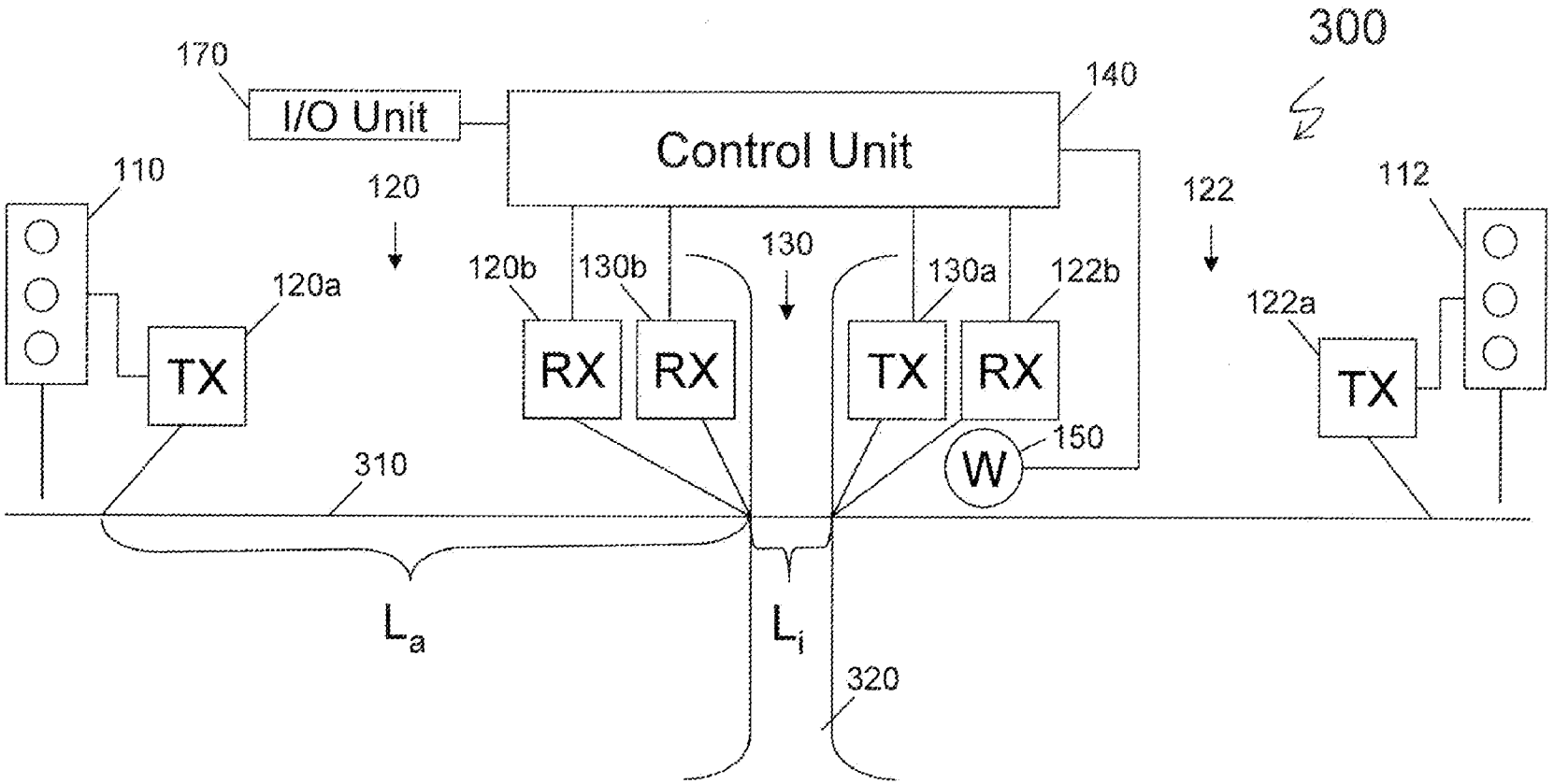
FIG. 3 is a schematic diagram of a second embodiment of grade crossing control system.

In a typical installation, a track occupancy circuit will be placed on either side of the road as shown in the system 300 of FIG. 3. In FIG. 3, a track 310 is shown crossing a road 320. A first track occupancy circuit 120 formed by a transmitter 120*a* and a receiver 120*b* connected through the rails 310 (although only one rail 310 is shown in the schematic diagram of FIG. 3, those of skill in the art will recognize that two rails are present) on the left side of the road 320. The transmitter 120*a* is separated from the receiver 120*b* by an approach length $L_a$ set at a desired distance as discussed above. A second track occupancy circuit 122 is formed on the right side of the road 320 by a transmitter 122*a* and a receiver 122*b*. An island circuit 130 having a length $L_i$ and formed by transmitter 130*a* and receiver 130*b* is present in the space between the track occupancy circuits 120, 122.

In the system 300, the track occupancy circuit transmitters 120*a*, 122*a* are configured to transmit a code based on an input from a external device as disclosed in commonly owned co-pending U.S. application Ser. No. 61/226,416 entitled "Track Circuit Communications," preferably using a frequency shift key technique as disclosed in commonly owned co-pending U.S. application Ser. No. 12/724,800 entitled "Decoding Algorithm for Frequency Shift Key Communications" (the "FSK application"). The contents of both of these applications are hereby incorporated by reference herein. The particular code is chosen based on an input from a respective wayside signal device 110, 112 such that a different code is chosen depending on the signal aspect. The track occupancy circuit receivers 1206, 122*b* are configured to decode the code transmitted by the respective transmitters 120*a*, 122*a*. The receivers are preferably configured to perform the decoding algorithm disclosed in the aforementioned FSK application. The control unit 140 utilizes the decoded code to control the warning system 150. The actual delays corresponding to the decoded codes may be set by a user using the I/O unit 170 during set up of the system 300. The embodiment of FIG. 3 has the advantage that no additional lines or radio/optical links are required to convey the switch aspect from the signal devices 110, 112 to the control unit 140 as these signal aspects are encoded on the signals transmitted by the track circuit transmitters 120*a*, 122*a*.

Figure 4:
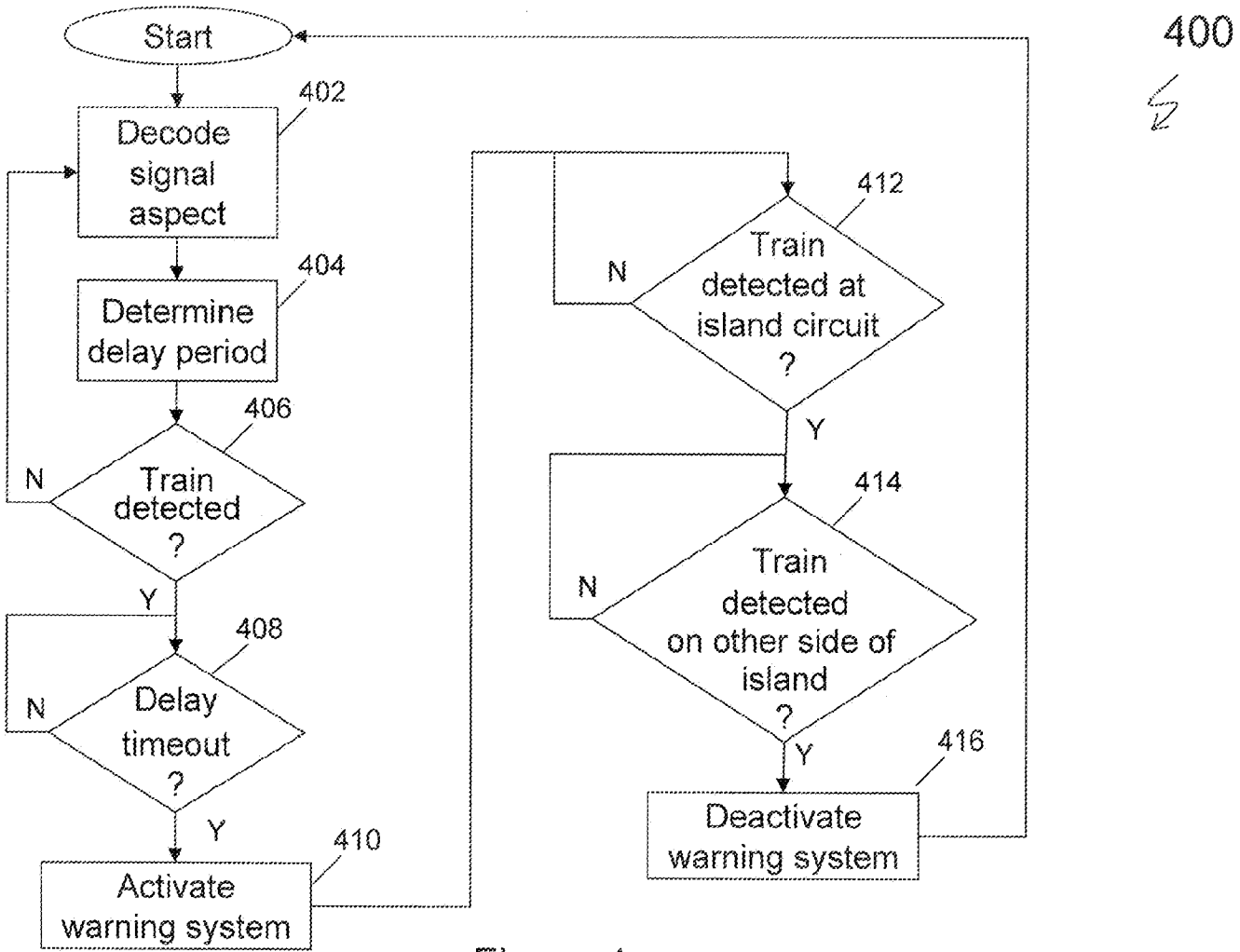
FIG. 4 is a flowchart of processing performed by a control unit of the system of FIG. 3.

The processing performed by the control unit 140 of the system 300 of FIG. 3 for a train crossing from left to right (which will be referred to as the eastbound direction) will be discussed with reference to the flowchart 400 of FIG. 4, which is similar in many respects to the processing illustrated in FIG. 2. Referring now to FIG. 4, the process begins with the control unit 140 decoding the signal received by the receiver 120*b* at step 402 (a code is also decoded from the signal received by the receiver 1226 at step 402). A delay period (which will be applied for any incoming train heading in the eastbound direction) based on the code decoded from receiver 120*b* in step 402 is determined at step 404 (the control unit 140 also determines a delay period for an incoming train in the opposite direction using the code received by receiver 122*b*). The delay period is determined by the control unit 140 in this embodiment using a lookup table that provides the delay period using the code as an index. In some embodiments, this table is hard-coded in the control unit 140; in other embodiments, the table entries of delays for the various signal aspects may be entered by the user using the I/O unit 170. If no train is detected, steps 402 and 404 are repeated. This is done because the signal aspect may change even if no train is detected. It should be understood that, in this embodiment, the presence of the train in the approach prevents any code from being received by the receiver 120*b*, and therefore the code must be read prior to the arrival of the train in the approach. Since the control unit 140 will not have any advance warning of an approaching train prior to the point in time in which the train's axles prevent reception of the code by the receiver 120*b*, the control unit must check the code being received by the receiver 120*b* often.

When the track occupancy circuit 120 detects an incoming eastbound train at step 406, the control unit 140 sets an internal timer to the corresponding delay determined at step 404 waits until the time expires at step 408. When the timer expires at step 408, the warning system 150 is activated at step 410. The control unit 140 then waits until the train is detected in the island circuit 130 at step 412. When the train clears the island circuit at step 414, the control unit 140 then checks to ensure that the train is detected by the track occupancy circuit 122 on the east side of the road 320 at step 414. If so, the warning system 150 is deactivated at step 416 and the process repeats.

Those of skill in the art will recognize that devices other than a signal aspect may be used to determine indirectly a maximum speed of a train. For example, in some situations, a trailing point switch (not shown in the figures) may be connected upstream of the track occupancy circuit 120 to switch either a high speed track or a low speed track to the track 310. In such a situation, the position of the switch may be used to determine the maximum allowable speed depending on which track is switched onto the track 310. Those of skill in the art will recognize that there are several other devices which may similarly indicate a time varying maximum allowable speed applicable to an inbound train.

The foregoing examples are provided merely for the purpose of explanation and are in no way to be construed as limiting. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

The purpose of the Abstract is to enable the patent office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present inventions in any way.

What is claimed is:

1. A method for controlling a grade crossing warning system comprising:

inputting by a control unit an indication of a time-varying maximum allowable speed of a train in an approach to a grade crossing;

determining by the control unit a delay period using the indication;

detecting the presence of a train in the approach by the control unit using a first track occupancy circuit;

activating by the control unit a grade crossing warning system in response to the train being detected and the delay period expiring.

2. The method of claim 1, wherein the indication is encoded onto a first track occupancy signal associated with the first track occupancy circuit.

3. The method of claim 1, wherein the indication comprises a code.

4. The method of claim 3, wherein the code is associated with a signal aspect from a wayside signal device.

5. The method of claim 3, wherein the code is associated with a setting of a track switch.

6. The method of claim 3, wherein the code is encoded onto the first track occupancy signal using a frequency shift key technique.

7. The method of claim 1, further comprising the steps of detecting the presence of the train in an island using an island circuit and deactivating the grade crossing warning system based at least in part on the presence of the train in the island.

8. The method of claim 1, further comprising the step of detecting the presence of the train using a second track occupancy circuit on a second side of the island opposite a first side of the island on which the first track occupancy circuit is disposed, wherein the deactivating step is further based at least in part on the presence of the train on the second side of the island.

9. A system for controlling a grade crossing warning device, the system comprising:

a control unit having an input for inputting an indication of a time-varying maximum allowable speed of a train in the approach;

a first track occupancy circuit connected to the control unit, the first track occupancy circuit being configured to detect a presence of a train in an approach to a grade crossing;

wherein the control unit inputs an indication of a time-varying maximum authorized speed of a train in the approach;

determines a delay period using the indication;

receives a first track occupancy signal from the first track occupancy circuit indicating the presence of a train in the approach: and activates a grade crossing warning system in response to the first track occupancy signal and an expiration of the delay period.

10. The system of claim 9, wherein the control unit further comprises a timer, and wherein the control unit is configured to initialize the timer with the delay period and start the timer when the signal from the first track occupancy circuit indicating the presence of a train in the approach is received.

11. The system of claim 9, wherein the indication comprises a code.

12. The system of claim 11, wherein the first track occupancy circuit includes a receiver and a transmitter, and wherein the transmitter is configured to encode the code onto the first track occupancy signal.

13. The system of claim 12 further comprising a wayside signal device connected to the transmitter, wherein the transmitter is configured to receive a signal aspect from the wayside signal device and select the code based on the signal aspect.

14. The system of claim 12, further comprising an indicator device connected to the transmitter and configured to output a signal indicative of a configuration of a track switch, wherein the transmitter is configured to receive the signal from the indicator device and select the code based on the signal indicative of the configuration of the track switch.

15. The system of claim 12, wherein the transmitter is configured to encode the code onto the first track occupancy signal using a frequency shift key technique.

16. The system of claim 9, further comprising:

an island circuit connected to the control unit;

wherein the control unit is further configured to perform the steps of detecting the presence of the train in an island using the island circuit; and deactivating the grade crossing warning system based at least in part on the presence of the train in the island.

17. The system of claim 9, further comprising:

a second track occupancy circuit on a second side of the island opposite a first side of the island on which the first track occupancy circuit is disposed, the second track occupancy circuit being connected to the control unit;

wherein the control unit is further configured to perform the step of detecting the presence of the train using the second track occupancy circuit; and wherein the deactivating step is further based at least in part on the presence of the train on the second side of the island.

18. The system of claim 9, further comprising a grade crossing warning system connected to the control unit.

* * * * *